US006357587B1

(12) United States Patent
Melms, Jr.

(10) Patent No.: US 6,357,587 B1
(45) Date of Patent: Mar. 19, 2002

(54) SHIPPING PACKAGING FOR DRAWER-TYPE STORAGE CABINET

(75) Inventor: Frederick G. Melms, Jr., Holland, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/672,732

(22) Filed: Sep. 28, 2000

(51) Int. Cl.[7] ..... B65D 85/00
(52) U.S. Cl. ..... 206/326; 206/320; 206/586
(58) Field of Search ..... 206/320, 326, 206/453, 497, 586, 591–594; 229/199, 199.1

(56) References Cited

U.S. PATENT DOCUMENTS

| | | | | |
|---|---|---|---|---|
| 4,483,444 A | * | 11/1984 | Gardner | 206/320 |
| 4,717,025 A | * | 1/1988 | Maurer | 206/586 |
| 4,919,263 A | * | 4/1990 | Baltzer et al. | 206/326 |
| 5,161,692 A | * | 11/1992 | Knierim | 206/586 |
| 6,155,419 A | * | 12/2000 | Sowa | 206/320 |
| 6,234,314 B1 | * | 5/2001 | Qiu et al. | 206/586 |

OTHER PUBLICATIONS

Drawing entitled "Haworth Packaging Standard; Standard No. 0552 Rev M". and Declaration by Frederick G. Melms.

* cited by examiner

*Primary Examiner*—Luan K. Bui
(74) *Attorney, Agent, or Firm*—Flynn, Thiel, Boutell & Tanis, P.C.

(57) ABSTRACT

A shipping package for accommodating a box-like object such as a drawer-type storage unit. The shipping package includes substantially identical top and bottom trays which respectively extend over top and bottom ends of the furniture unit, and a set of four corner posts which embrace vertically extending corners of the furniture unit and have opposite ends engaged with the trays. The corner posts comprise elongate L-shaped members which are hollow in cross-section and are relatively rigid to permit transmission of vertical stacking loads therethrough. The bottom tray mounts therein a load-bearing insert structure which includes two inserts, each formed from a one-piece corrugated fiber-board blank, with the inserts being secured within the tray and having raised upper surfaces which are in load-bearing engagement with the bottom frame of the furniture unit. The inserts also have appropriate recesses for accommodating legs or casters provided on the furniture unit. The top tray has a pair of shock-absorbing inserts secured therein and disposed in supportive engagement with the upper surface of the furniture unit. The entire shipping package is appropriately secured, such as by plastic stretch wrap and plastic banding.

14 Claims, 10 Drawing Sheets

SHIPPING PACKAGING FOR DRAWER-TYPE STORAGE CABINET

FIELD OF THE INVENTION

This invention relates to an improved shipping package for a relatively bulky and heavy object, such as a furniture unit.

BACKGROUND OF THE INVENTION

Numerous bulky and heavy objects are factory preassembled, appropriately packaged, and then shipped frequently by truck to a location for installation and use. The packaging for the object often involves corrugated containers or trays used in association with various inserts, typically plastic foam inserts which are capable of providing cushioning and are shaped to conform to the specific object, with the overall package also often frequently being appropriately banded, such as with plastic shrink wrap. During shipping and handling, however, the packaged objects are often treated quite roughly, and are often vertically stacked on top of one another either when in the warehouse or when contained in a transport such as a truck trailer, and thus most manufacturers experience significant damage to at least a significant number of shipped articles.

Further, most of the packaging containers used for bulky and/or heavy objects require customized inserts as well as exterior cartons or trays so as to accommodate the specific size and configuration of the object, and hence the number of different individual packaging elements which must be inventoried so as to accommodate a wide variety of shapes and sizes thus greatly increases the overall complexities and costs associated with the packaging operation.

The problem of product damage incurred during shipping is particularly of concern in the office furniture industry since office furniture products are generally wholly manufactured and in most cases substantially fully assembled at the factory, and are then packaged and shipped to the purchaser, who expects the product to arrive in a non-damaged or non-marred condition since the product will be used in an exposed environment, namely an office environment. The packaging and shipping problem in the office furniture industry is further complicated by the fact that many standard furniture components are manufactured in a significant variety of sizes which may involve the same product being sold in a wide variety of depths, heights or the like. Packaging which can accommodate different product designs, and the significant sizes within each design, has thus required that the manufacturer maintain a large number of different packaging components so as to accommodate the wide variety of styles and sizes of products.

Accordingly, it is an object of this invention to provide an improved shipping package which is particularly desirable for use in shipping a relatively heavy object or unit of significant size, which improved shipping package provides increased protection and load carrying capability relative to prior known shipping packages utilized for such objects, is adaptable to various forms and modifications of the object or unit being shipped so as to minimize the number of different shipping package components required, and overcomes or at least minimizes many of the disadvantages associated with prior shipping packages utilized for shipping units of this type.

The improved shipping package is designed specifically for accommodating an object of significant size and weight, more specifically a box-like object which in the preferred embodiment comprises a furniture unit and more specifically a drawer-type storage unit. The shipping package includes substantially identical top and bottom trays which respectively extend over the top and bottom ends of the furniture unit, and a set of four corner posts which embrace the vertically extending corners of the furniture unit and have opposite ends engaged with the trays to permit vertical load transfer therebetween, such as when a plurality of packages are disposed in vertically stacked relationship, to prevent the stacking loads from being transmitted through the furniture unit. The corner posts comprise elongate L-shaped members which are hollow in cross-section and are relatively rigid to permit transmission of vertical stacking loads therethrough. The lower tray mounts therein an improved load-bearing insert structure which includes two inserts, each formed from a one-piece corrugated fibre-board blank, with the inserts being secured within the tray and having raised flat upper surfaces which are in load-bearing engagement with the bottom frame of the furniture unit. The inserts also have appropriate recesses for accommodating legs or casters provided on the furniture unit. The top tray also has a pair of shock-absorbing inserts, such as of honeycomb material, secured therein and disposed in supportive engagement with the upper surface of the furniture unit. The entire shipping package is appropriately secured, such as by plastic stretch wrap and plastic banding.

The improved shipping package of the present invention, including objects and purposes thereof, will be apparent to persons familiar with constructions of this general type upon reading the following specification and inspecting the accompanying drawings.

Figure 1:
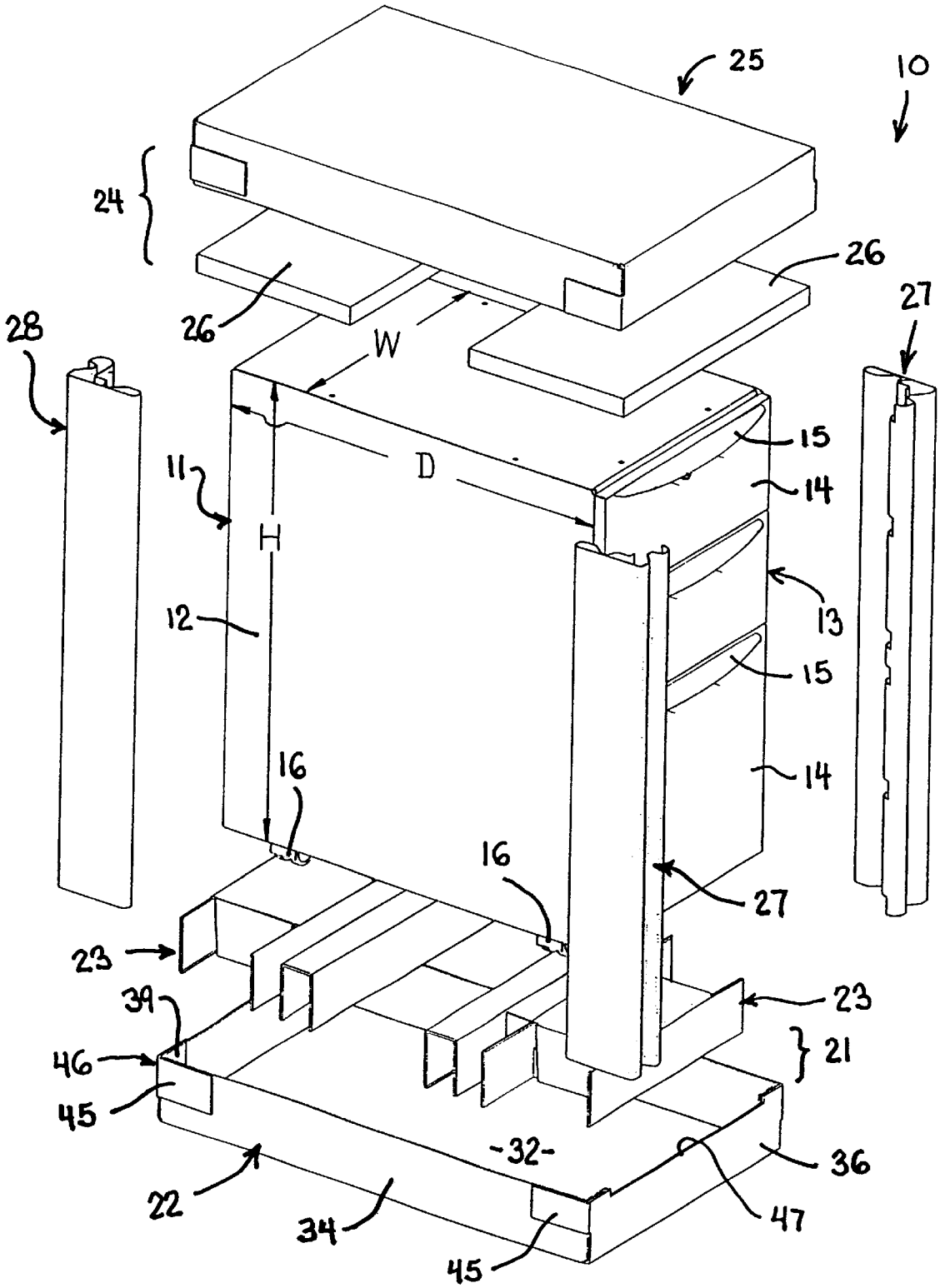
FIG. 1 is an exploded perspective view of the improved shipping package of the present invention, and its cooperation with a furniture unit.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, there is illustrated a shipping package 10 according to the present invention. This package is intended for use with a box-like object 11 having significant size and weight, which object 11 in the illustrated and preferred embodiment comprises a furniture unit which more specifically is a file or storage unit which in the office furniture industry is typically referred to as a pedestial or "ped". The unit 11 includes a hollow box-like housing 12 which is typically of metal wall construction, and which supports thereon one or more drawers 13 which are disposed interiorly of the housing and have drawer fronts 14 which are typically disposed at and close off an open side of the housing when the drawers are in the closed position. The illustrated unit 11 has three drawers, but the number of drawers is variable, depending on the size of the unit and the size of the individual drawers. The drawers 13 in the illustrated embodiment have pulls 15 which are fixed to the individual drawer fronts to permit gripping and hence opening and closing of the drawers. The pulls 15 in the illustrated embodiment are horizontally elongated so as to extend over a majority of the width of the drawer front, and the pulls 15 also project horizontally outwardly beyond the front surface of the drawer front 14. The furniture unit 11 in the illustrated embodiment also has support feet, specifically casters 16, mounted on the unit and projecting downwardly adjacent the four corners thereof for rollingly supporting the unit on a floor.

The furniture unit 11, as described above, may be utilized in several variations, one being with casters so that the unit is supportingly engaged directly on the floor, or in place of casters the unit can be provided with stationary glides or feet, or the unit may be provided with a base platform which supports the unit and which itself directly sits on the floor, or alternatively the unit may be secured to the underside of a work surface so that the lower end of the unit is free of engagement with the floor. In addition to the variations in which the furniture unit is supported, either from above or below, the furniture unit is also provided in selected sizes, including primarily a series of different heights and depths, as respectively indicated by the dimensions H and D, while utilizing a predefined width W.

Figure 14:
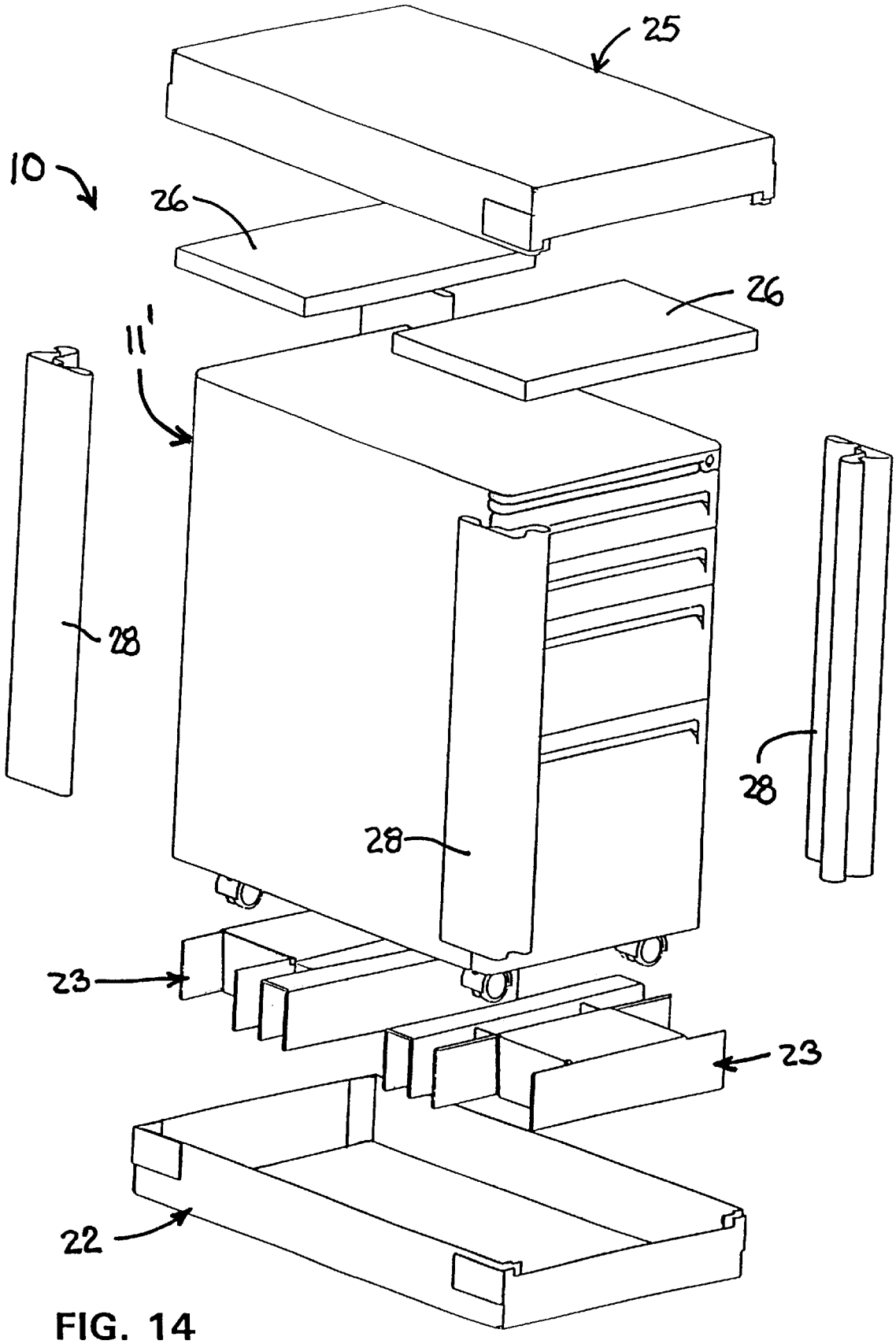
FIG. 14 is an exploded perspective view similar to FIG. 1 but illustrating the improved shipping package used in conjunction with a modified furniture unit.

In addition to variations with respect to both the mounting of the furniture unit and the size thereof as discussed above, different styles of furniture units can also be provided, and an example of a modified furniture unit 11' is illustrated in FIG. 14 wherein the drawer fronts have recessed pulls, rather than outwardly projecting pulls as with the unit 11 of FIG. 1.

The shipping package 10 illustrated in FIG. 1 is defined by a bottom tray assembly 21 which includes a bottom tray 22 having a pair of identical inserts 23 secured therein for supportingly engaging the lower end of the furniture unit 11, a top tray assembly 24 which includes a top tray 25 having a pair of identical inserts or liners 26 therein for cushioned engagement with the upper end of the furniture unit, and pairs of front and rear upright corner posts 27 and 28 for embracing the upright corners of the furniture unit, which posts are supportingly engaged at opposite ends with the upper and lower tray arrangements for permitting transfer of vertical loads between the upper and lower trays directly through the corner posts. The shipping package 10 defined by the corner posts and their cooperation between the upper and lower tray assemblies is suitably secured in enclosing engagement with the furniture unit 11 by appropriate banding such as surrounding plastic wrap, such being conventional and well known, and hence not illustrated in the drawings.

Figure 2:
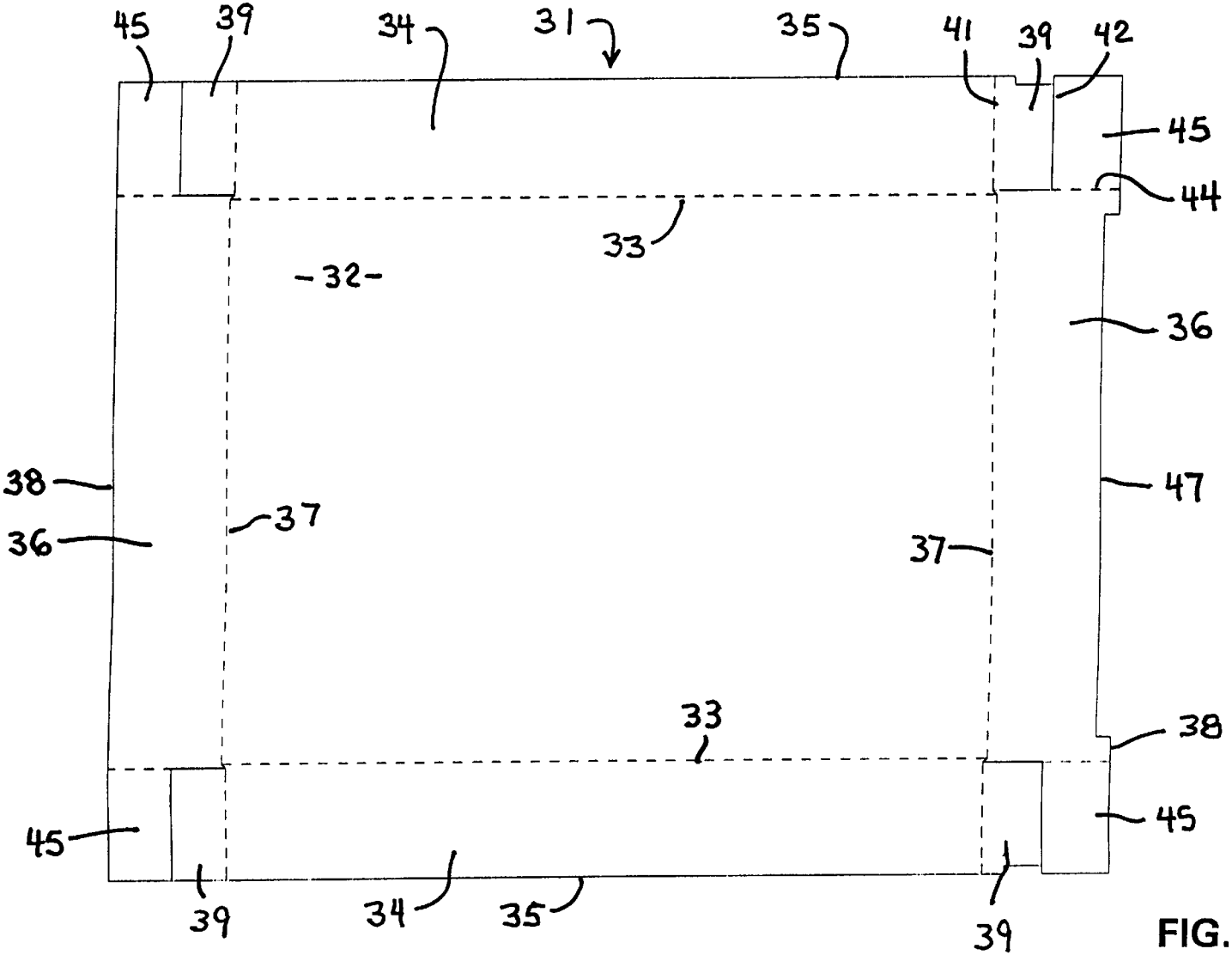
FIG. 2 is a plan view of the flat blank used for forming the top and bottom trays.
Figure 3:
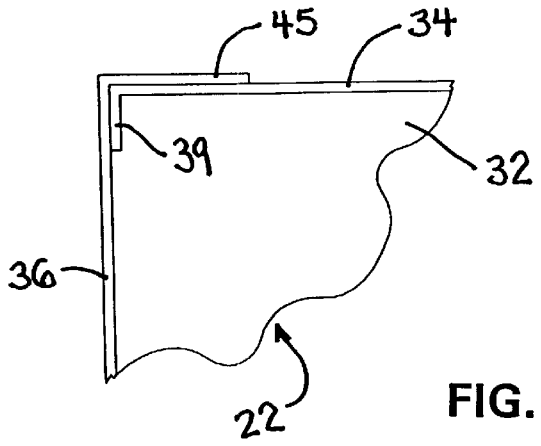
FIG. 3 is an enlarged, fragmentary view illustrating the assembled corner of the tray formed from the blank of FIG. 2.
Figure 2A:
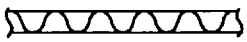
FIG. 2A is a fragmentary diagrammatic cross section of the fibre-board which frames the blank of FIGS. 2 and 6.

The bottom tray 22 is defined by and formed from a large one-piece blank 31 (FIG. 2) of sheetlike material, preferably single-wall corrugated fibre-board (i.e. a fluted or corrugated paper sheet bonded between two kraft paper facing sheets as shown in FIG. 2A). The blank is provided with appropriate fold and cut lines so as to define a large rectangular center portion 32 which defines the bottom wall of the tray. Opposite sides of the bottom wall 32 are defined by generally parallel fold lines 33 which define a bendable corner for connection to upright side walls 34 which extend along the length of the bottom wall and project upwardly through a small extent so as to terminate at a free upper edge 35. The blank 31 has a further pair of fold lines 37 which extend perpendicularly between the fold lines 33 and define opposite ends of the bottom wall 32. These fold lines 37 define right angle corners for connection with end walls 36 which extend along the ends of the bottom wall and project upwardly through a small distance so as to terminate at upper free edges 38. The side and end walls 34 and 36, respectively, are typically of about the same height.

To define the upright corners of the bottom tray 22, each side wall 34 has a small generally rectangular end flap 39 joined at each longitudinal end thereof through a fold line 41 which extends between fold line 33 and free edge 35, with the fold line 41 being substantially aligned with the fold line 37. End flap 39 is additionally defined by an L-shaped cut line which includes a first cut 42 which extends perpendicularly inwardly from the edge 35 and joins to a second cut 43 which extends perpendicularly from the cut 42 for merger with the fold line 41 substantially at the corner of the bottom wall 32, whereby the cut 43 is approximately aligned with the fold line 33. The cut 42 is disposed approximately midway between the fold line 37 and edge 38, so that end flap 39 has a width which is approximately one-half the width of end wall 36, but a height which corresponds to the height of the side wall 34.

Each corner of the blank 31 has a further substantially rectangular end flap 45 associated therewith, the latter being defined on three sides thereof by the edges 35 and 38 and the cut line 42, with the fourth side of end flap 45 being defined by a fold line which extends substantially between cut line 42 and edge 38 and is substantially aligned with the cut line 43.

The flap structure as defined at each corner of the blank 31 thus include the end flap 39 which remains monolithically joined to the end of the side wall 34 but is foldable relative thereto about the fold line 41, and the end flap 45 which remains monolithical.ly joined to the end of the end wall 36 and is foldable relative thereto about the fold line 44. The end flap 45 as joined to the end wall 36 effectively constitutes an extension of the upper edge 38 of the end wall 36, but has a height which is less than the height of the end wall 36, which height in the illustrated embodiment is approximately one-half the end wall height.

With the blank arrangement illustrated by FIG. 2 and specifically the provision of end flaps 39 and 45 associated with each corner of the blank, the blank 31 is appropriately folded to define the upwardly-opening bottom tray 22. This is accomplished by folding the side walls 34 upwardly about the fold lines 33, and by folding the end walls 36 upwardly about the fold lines 37. The end flaps 39 are similarly folded 90° inwardly about the respective fold lines 41 so that the outer surfaces of end flaps 39 overlap and are appropriately secured, as by adhesive or gluing, to the opposed inner surface of the end wall 36. The outer end flaps 45 are also folded 90° inwardly about fold lines 44 so that the inner surface of each flap 45 overlaps and is appropriately secured, as by adhesive or gluing, to the opposed outer surface of the side wall 34. With this arrangement, each side wall has a flap which overlaps and is secured by gluing or adhesive to the adjacent end wall at the respective corner, and simultaneously each end wall has a flap which overlaps and is secured by adhesive or gluing to the side wall at the respective corner, with one of the flaps being positioned interiorly of the tray and the other positioned exteriorly of the tray, thereby providing the assembled tray with a strong corner construction.

If necessary or desirable, the upper edges of the side and/or end walls of the tray can be provided with recesses therein, such as indicated by the recess 47 associated with one of the end walls 36 in FIG. 1, to provide appropriate clearances or the like.

As to the top tray 25, it is identical to the bottom tray 22 except that, in use, it is oriented so as to open downwardly in opposition to the upwardly-opening orientation of the bottom tray 22. Further detailed description of top tray 25 is believed unnecessary.

Figure 4:
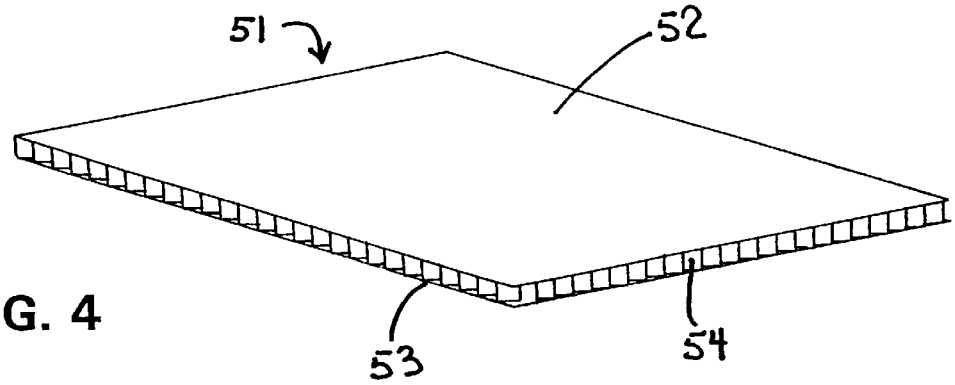
FIG. 4 is a perspective view which illustrates the liner which is attached within the top tray.

To define the top tray assembly 24, the top tray has the pair of inserts 26 fixedly positioned therein, which inserts each comprise a one-piece liner member 51 (FIG. 4) which in plan view has a generally rectangular configuration so that the liner has a platelike configuration. The liner in the illustrated and preferred embodiment is constructed entirely of paper or cardboard and includes upper and lower paper facing sheets 52 and 53 which are secured to and sandwich therebetween a conventional paper honeycomb core. The liner 51 has significant thickness, with the thickness normally being at least approximately three-fourths inch, and preferably being at least approximately one inch. The hexagonal cells of the honeycomb core 54 preferably have a cross-sectional width of about three-fourths inch or less, and are oriented in perpendicular relationship to the facing sheets so that the liner, due to its construction, provides significant cushioning and shock-absorbing capability when engaged against the upper surface of the furniture unit to provide for desired protection of the unit during shipping and handling.

Figure 5:
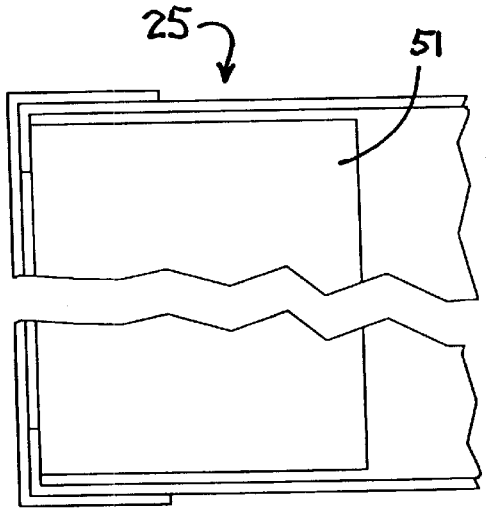
FIG. 5 is a fragmentary bottom view of the top tray having the liner of FIG. 4 secured therein.

The liner 51 is sized so that, when positioned interiorly of the top tray, as illustrated by FIG. 5, it is positioned so as to substantially abut against the end wall of the top tray, and extends across and substantially occupies the full width of the top tray as defined between the side walls thereof. A pair of identical such liners 51 are secured to the top tray, such as by being bonded or glued to the inner surface of the bottom wall 32, at opposite ends of the top tray for appropriate load-bearing engagement with the top of the furniture unit adjacent opposite ends thereof.

Considering now the bottom tray assembly 21 and specifically the inserts 23 associated therewith, each insert 23 is formed from a monolithic one-piece sheetlike blank 61 (FIG. 6), also preferably of single-wall corrugated fiberboard. The blank 61 is appropriately folded and formed so as to define, at the outer end thereof, a hollow box-like structure 62 (FIG. 7) which is disposed for supportive engagement with the underside of the furniture unit adjacent one end thereof. The forming of blank 61 into the insert 23 also results in formation of a tubular structure 63 disposed adjacent the inner end of the insert, which tubular structure 63 extends transversely across the center portion of the bottom tray, with opposite ends of the tubular structure 63 being joined to channel parts 64 which extend outwardly toward the opposed tray sidewalls 34. The channel parts 64 function to supportingly engage the underside of the furniture unit adjacent opposite sides thereof.

Figure 6:
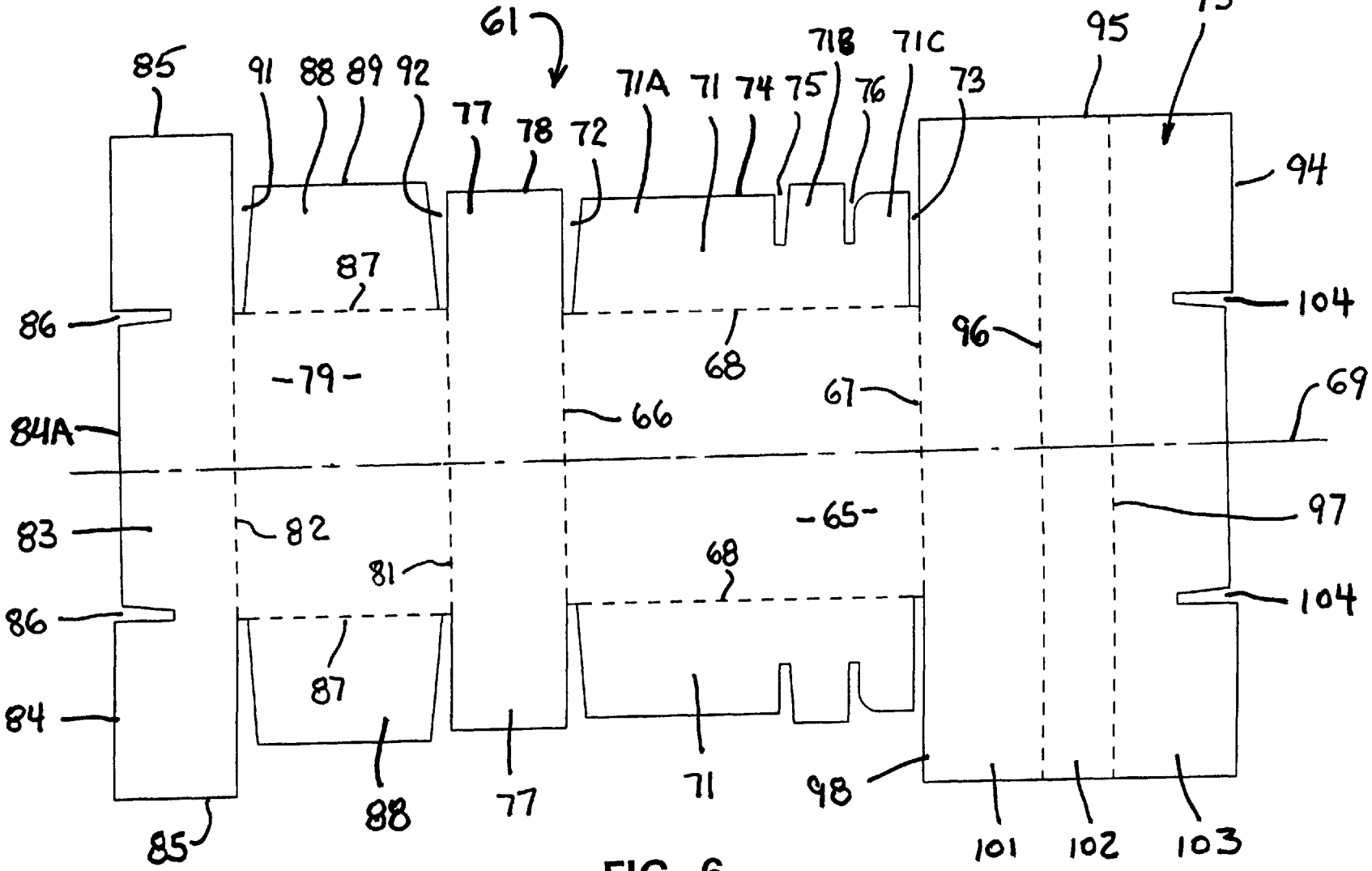
FIG. 6 is a plan view of a one-piece flat blank used for forming one of the inserts which are positioned within the bottom tray.

Referring to FIG. 6, the one-piece insert blank 61 includes a generally rectangular main base wall 65 which at opposite ends is defined by generally parallel fold lines 66 and 67, which fold lines extend perpendicularly between generally parallel side fold lines 68, the latter being parallel with and substantially equally spaced on opposite sides of the longitudinally extending centerline 69 of the blank, which blank is generally symmetrical on opposite sides of this centerline.

Each side of base wall 66 is joined through the respective fold line 68 to an edge flap 71 which terminates in an outer free edge 74. The flap 71 has a length which generally corresponds to the base wall 65 so that the ends of the flap are defined by cuts or slots 72 and 73 which project inwardly from the outer edge 74 and terminate at the respective fold line 68. The edge flap 71 also has a pair of slits or slots 75 and 76 which extend inwardly from the edge 74 toward but terminate short of the fold line 68. The slot 76 is spaced a small distance from the edge cut 73 so as to define a first flap portion 71C therebetween, and the slit 75 is spaced a similar distance inwardly from the slit 76 so as to define a further flap portion 71B therebetween. The slit 75 is disposed a substantial distance from the other edge slit 72 so as to define a third flap portion 71A therebetween, which flap portion 71A in the illustrated embodiment has a length which at least preferably equals and, as shown, slightly exceeds the combined longitudinal length of the flap portions 71B and 71C, which latter flap portions are of similar width.

The main base wall 65 at one end thereof joins through the fold line 66 to an edge wall 77, the latter at its other side being joined to a further fold line 81 which extends parallel with fold line 66, with the spacing therebetween being a small fraction of the length (as measured along centerline 69) of base wall 65. In fact, the width of edge wall 77, as measured by the spacing between fold lines 66 and 81, is approximately equal to and normally is slightly less than the height of the end walls 36 of the bottom tray 22. The edge wall 77, however, is of greater width than the base wall 65, and in fact edge wall 78 terminates in generally parallel outer edges 78 which are spaced from centerline 69 by a distance which is similar to, and in fact somewhat greater than, the spacing between centerline 69 and edge wall 74.

The insert blank 61 also includes a generally rectangular top wall 79 which extends lengthwise along centerline 69 from the fold line 81 to a further fold line 82, the latter being parallel with the fold line 81. This top wall 79 has a width which is defined between fold lines 87 which are disposed symmetrically on opposite sides of and extend generally parallel with the centerline 69. The fold lines 87 are substantially aligned with fold lines 68 so that the top wall 79 has generally the same width as the bottom wall 65. Top wall 79, however, is of lesser longitudinal length than bottom wall 65, and in fact the longitudinal length of top wall 79 as defined between fold lines 81 and 82 approximately corresponds to the longitudinal length from fold line 66 to an imaginary line which extends between and joins the edge slits 75.

An edge wall 83 is defined at one end of the blank 61, which edge wall 83 extends longitudinally between the fold line 82 and the outer free edge 84 of the blank. The edge wall 83 as measured generally along the centerline 69 has a dimension, as defined between fold line 62 and free edge 84, which approximately equals the lengthwise dimension of the edge wall 77. The edge wall 83 has a width which extends between outer end edges 85 which are parallel with and disposed symmetrically on opposite sides of centerline 69, with edges 85 being spaced outwardly beyond the end edges 78 of the edge wall 77. In fact, the width of edge wall 83 as defined between the end edges 85 is approximately equal to but normally slightly less than the interior width of the assembled bottom tray. This end flap 83 also has a pair of slits or slots 86 which open inwardly from free edge 84 and extend toward but terminate short of the fold line 82. These slots 86 are approximately aligned with the fold lines 87. The center portion of end wall 83, namely that portion which extends between the pair of slots 86, is also partially removed so that the free edge 84 of the center portion is spaced a small distance inwardly from the free edge 84 defined by the outer portions of the end wall.

The top wall 79 also has a pair of flaps 88 which project outwardly from opposite sides of the top wall and are joined thereto through the respective fold lines 87. These flaps terminate in lengthwise-extending free edges 89 which are generally parallel with centerline 69, and are spaced outwardly slightly beyond the adjacent end edges 78, but spaced inwardly a substantial distance from the adjacent end edges 85. The flaps 88 extend longitudinally throughout the length of the top wall 79 and, at opposite ends, terminate at cuts or slots 91 and 92 which project transversely inwardly from the outer edge 89 so as to terminate at the respective fold line 87.

The other end of the insert blank 61 defines thereon a generally rectangular blank part 93 which extends longitudinally from the fold line 67 to a free edge 94 which extends generally parallel to the fold line 67. The blank part 93 has a width which is defined between free end edges 95 which extend parallel with and are symmetrically disposed on opposite side of the centerline 69, with these edges 95 extending from the free end edge 94 to the slits 73 which align with the fold line 67. The dimension between edges 85 represents the maximum width of the blank 61, which edges 95 are spaced outwardly a substantial distance beyond the outer edges of the flaps 71 and 88, and in fact in the illustrated embodiment the edges 95 are substantially aligned with the outer edges 85 of the end wall 83. The blank part 93 has a pair of generally parallel fold lines 96 and 97 formed therein and extending generally perpendicularly between the free edges 95. The fold lines 96 and 97 are positioned such that the perpendicular distance between edge 98 and fold line 96 substantially equals the perpendicular distance between fold line 97 and edge 94, whereas in the illustrated arrangement a somewhat smaller perpendicular distance is defined between the fold lines 96 and 97. The perpendicular distance between fold lines 96 and 97 approximately corresponds to the perpendicular distance between fold line 67 and a line which defines an imaginary extension between the slits 76 defined in the flaps 71.

The blank part 93 and the presence of the intermediate fold lines 96 and 97 hence cause the blank part 93 to be divided into three generally rectangular wall portions 101, 102 and 103. Wall portion 101 functions as an edge or side wall, wall portion 102 functions as a top wall, and wall portion 103 functions as an edge or side wall of the tubular structure 63 and channel parts 64 as described hereinafter. The wall portion 103 also has a pair of slits or slots 104 which are formed inwardly from free edge 94 so as to project toward but terminate short of the fold line 97. The slots 104 are approximately aligned with the fold lines 68.

To form the flat blank 61 into the assembled three-dimensional insert 26, the blank is folded about the fold line 66 so that edge wall 77 projects upwardly, and the blank is further folded about fold line 81 so that the top wall 79 is disposed generally over and spaced upwardly from the bottom wall 65. The edge flaps 71 are folded upwardly, and the top wall edge flaps 89 are then folded downwardly so as to exteriorly overlie the upwardly folded bottom edge flaps 71. The end wall 83 is then folded downwardly about fold line 82 and the slots 86 thereof are aligned with and interfitted within the slots 75 of the bottom wall edge flaps 71 so as to interlock the edge wall 83 to the side flaps 71. In addition, the opposed surfaces of the overlapping flaps 71 and 88 are secured together by adhesive or gluing so as to define the substantially closed box structure 62.

The blank part 93 is also folded upwardly about the fold line 67 defined at the other end of the base wall 65, with the blank part 93 thereafter being appropriately folded about the fold line 96 so that the wall portion 102 effectively overlies the flap portions 71C. The blank part 93 is also folded about fold line 97 so that wall portion 103 projects downwardly, whereupon the slots 104 therein are aligned with and interfitted within the slots 76 so as to effect interlocking of the edge wall portion 103 with the side flaps 71. With this latter interlocking, the flap portions 71C project interiorly into the inverted channel-shaped configuration defined by the folded blank part 93, which folded blank part 93 cooperates with part of the base wall 95 to define a closed tubular structure which extends for a selected distance on opposite sides of the centerline 69, with the outer ends of the folded blank part 93, namely those portions spaced outwardly from fold lines 68, defining the downwardly-opening channel parts 64. When in this overall folded and assembled condition, the intermediate flap parts 71B project upwardly between the edge wall portions 83 and 103 so as to provide additional structural stability and rigidity to the assembled insert.

Figure 7:
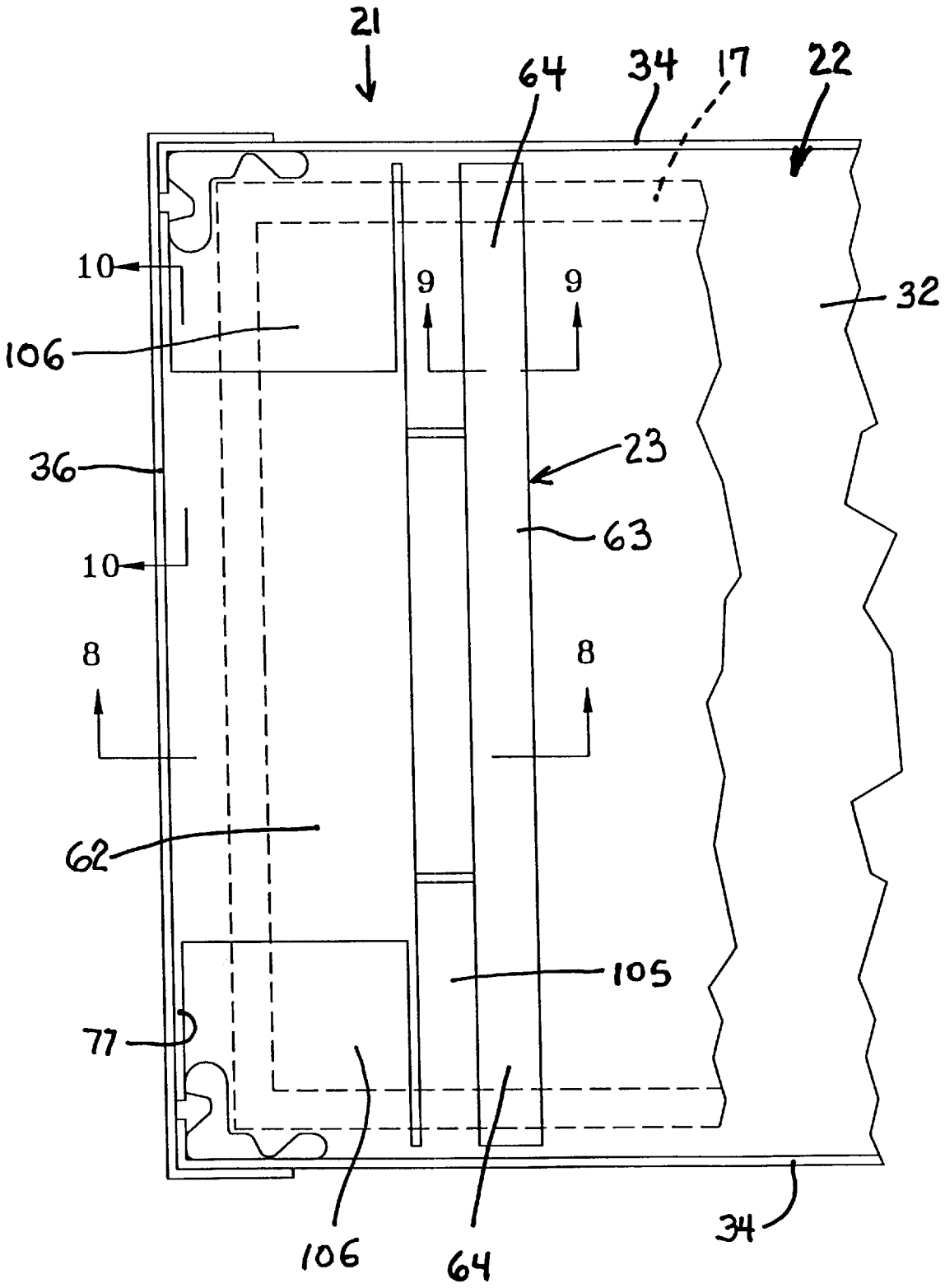
FIG. 7 is a fragmentary plan view of the assembled bottom tray having one of the assembled inserts secured therein.

With the insert assembled as described above, then identical such inserts are positioned within the interior of the bottom tray 22 adjacent opposite ends thereof, only one such insert being illustrated in FIG. 7. Each insert is positioned so that the box structure 62 is disposed closely adjacent the tray end wall 36, and preferably the insert is positioned so that the insert edge wall 77 abuts the inner surface of the end wall 36, with the opposed surfaces of the walls 77 and 36 being preferably fixedly secured together by adhesive or glue so as to fixedly maintain the insert in the desired positional relationship within the tray.

With the inserts properly secured in the bottom tray as illustrated by FIG. 7, the box structure 62 hence effectively abuts and projects inwardly from the center portion of the tray end wall 36, and thus the upper wall of the box structure 62 is disposed for supportive engagement with the underside of the furniture unit adjacent one end thereof, which unit typically has a rectangular frame along the outer bottom edge thereof as indicated by dotted lines 17 in FIG. 7. At the same time, the inverted channel parts 64 are disposed adjacent opposite sides of the bottom tray at a distance spaced outwardly a limited extent from the respective end wall 36, and hence these channel parts 64 are disposed for supportive engagement with opposite sides of the bottom of the furniture unit at a location which is displaced from the center of the furniture unit and hence is disposed more closely adjacent one end thereof.

Figure 8:
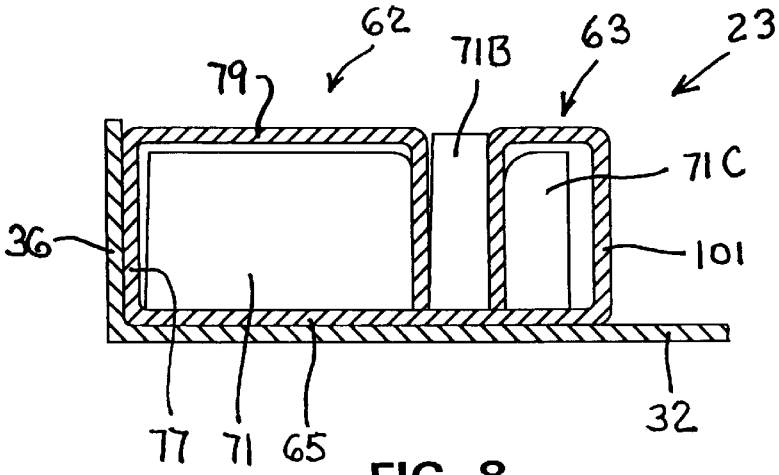
FIG. 8 is an enlarged, fragmentary sectional view taken along line 8—8 in FIG. 7.
Figure 9:
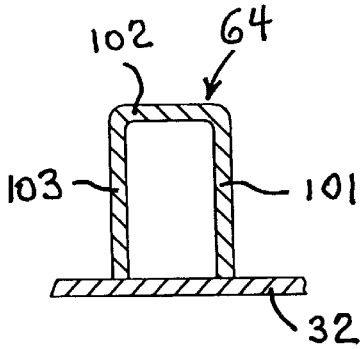
FIG. 9 is an enlarged, fragmentary sectional view taken along line 9—9 in FIG. 7.
Figure 10:
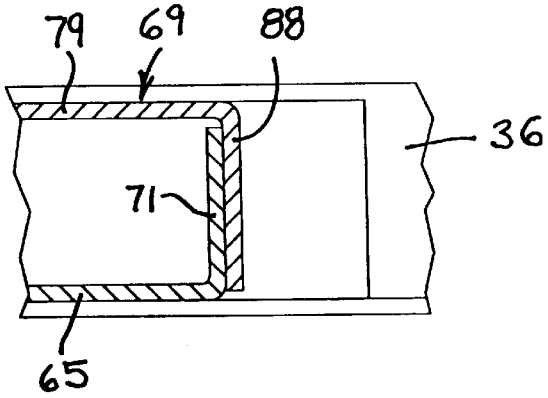
FIG. 10 is an enlarged, fragmentary sectional view taken along line 10—10 in FIG. 7.

The insert 23, when assembled and positioned within the bottom tray, has the upper surface thereof as defined by the box structure 62 and the channel structure 64 disposed at an elevation which is similar to but normally spaced downwardly a small distance from the upper edge of the tray walls 34 and 36, as illustrated by FIGS. 8 and 10. The weight of the furniture unit is thus supported directly on the insert which, due to the tubular and/or box-like configuration thereof, possesses substantial strength while at the same time, due to the hollow configuration thereof, permits proper cushioning of the furniture unit against undesired impact loads.

The assembled insert and its cooperation with the bottom tray, as illustrated in FIG. 7, results in the formation of a pair of recesses 106 which are generally rectangular in as configuration and are disposed generally at the corners of the bottom tray. These recesses, which extend throughout the height of the insert, readily accommodate therein the downwardly projecting casters or feet which may be provided on the furniture unit. These recesses 106 also accommodate therein the lower ends of the corner posts, as indicated at 27, and as described in greater detail hereinafter.

Figure 11:
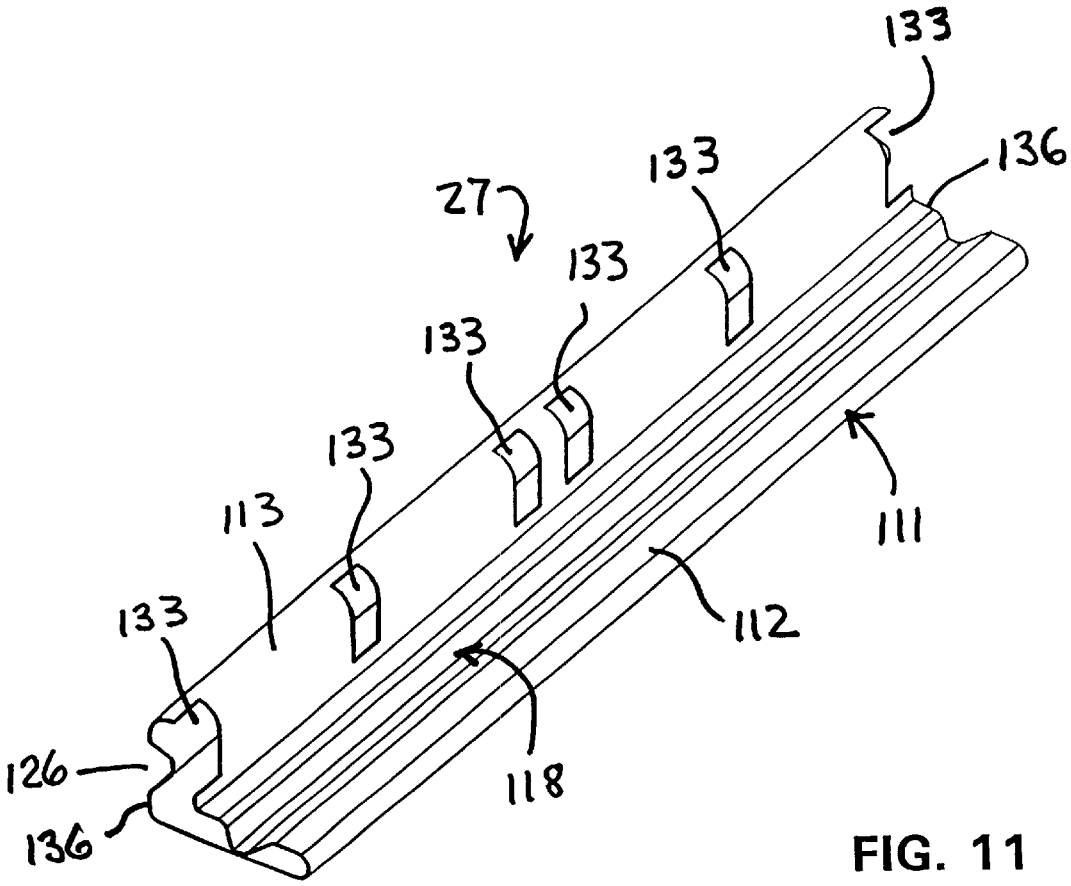
FIG. 11 is a perspective view of one of the corner posts.
Figure 12:
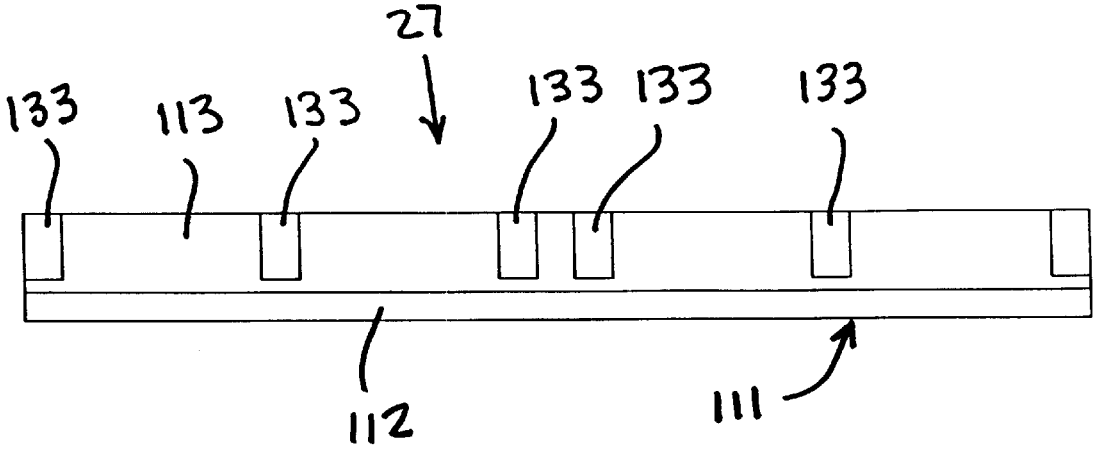
FIG. 12 is a side view of the corner post shown in FIG. 11.
Figure 13:
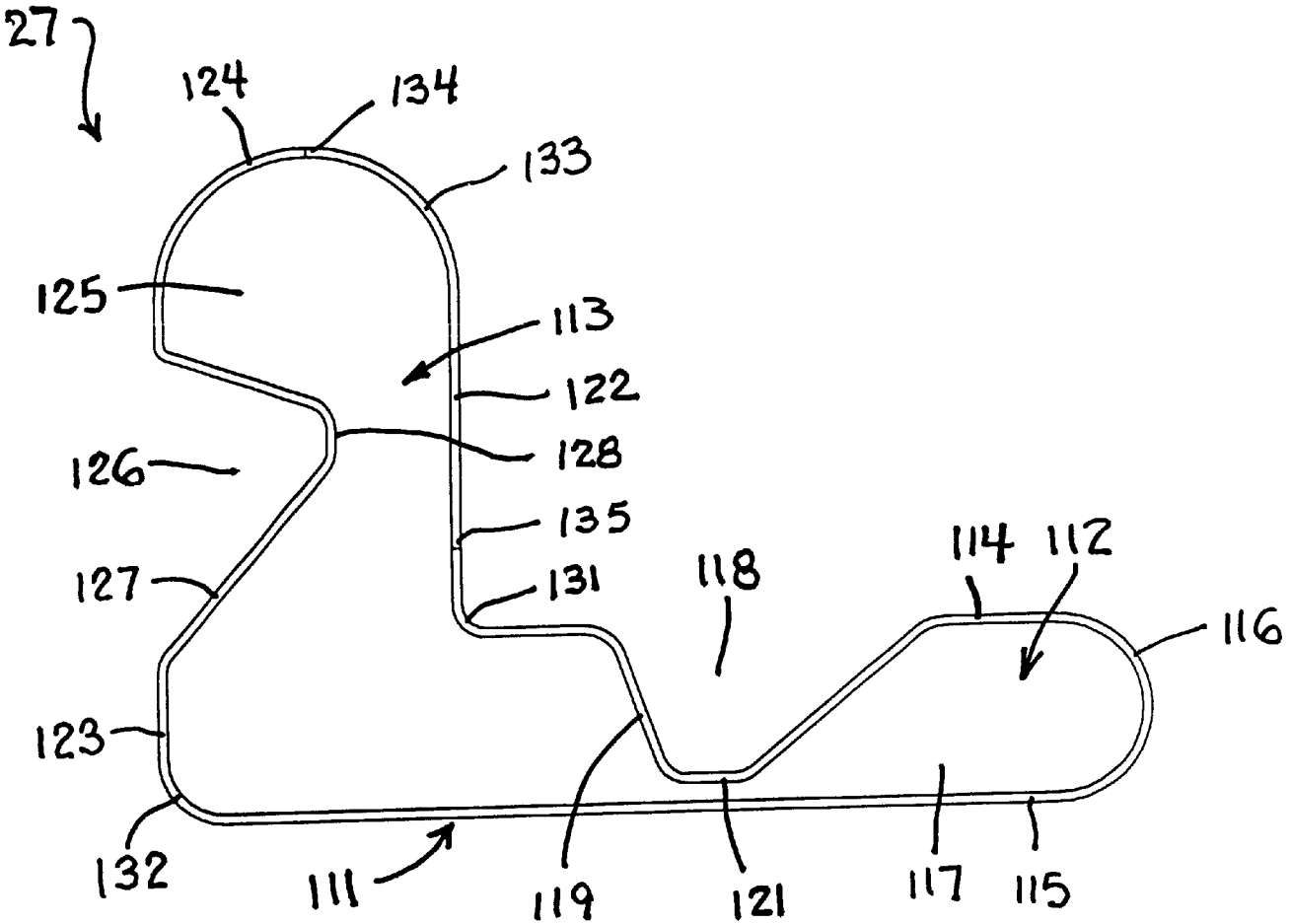
FIG. 13 is an enlarged end view of the corner post of FIGS. 11 and 12.

Considering now the upright posts and specifically the front corner posts 27, and referring specifically to FIGS. 11–13, each post 27 comprises an elongate, monolithic, one-piece hollow tube 111 having a generally L-shaped cross-section defined by hollow legs 112 and 113 which extend generally perpendicular with respect to one another, and extend generally along the entire length of the tube.

The leg 112, as illustrated by FIG. 13, includes spaced inner and outer walls 114 and 115 respectively, which at outer ends are joined by a rounded or arcuate convex end wall 116 so as to effectively close off the hollow interior 117 of the leg. The inner wall 114 has a depression or groove 118 formed therein and extending throughout the lengthwise extent of the hollow tube 111. This groove 118 is defined by a channel-like wall part 119 which is associated with and projects inwardly from the wall 114, with the bottom wall 121 of this wall part 119 being positioned closely adjacent but spaced from an inner surface of the outer wall 115. The groove 118, as illustrated by FIG. 13, is disposed approximately midway along the outwardly projecting extent of the leg 112.

The other leg 113 is similarly formed by spaced and generally parallel inner and outer walls 122 and 123, respectively, which at outer ends are closed by a rounded or arcuate convex end wall 124 so as to enclose the hollow interior 125 of the leg. The leg 113 also has a groove or depression 126 which is formed inwardly from the outer wall 123, and which extends lengthwise throughout the length of the tube 111. The groove 126 is defined by a channel-like wall part 127 which projects inwardly from outer wall 123 toward opposed inner wall 122, with this channel-like wall part 127 defining a bottom wall 128 which is spaced inwardly from outer wall 123 but is also spaced a substantial distance from inner wall 122, with bottom wall 123 in the illustrated arrangement being disposed approximately centrally or midway between the walls 122 and 123. The groove 126 as formed in the outer wall 123 is disposed approximately midway along the outward extent of the leg 113.

The grooves 118 and 126 as associated with the respective hollow legs 112 and 113 provide the hollow legs with significantly increased strength and rigidity. In addition, forming of the groove 118 so that it opens from the inner wall 114 provides the leg 112 with greater side impact strength, and hence provides greater protection to the furniture unit relative to damage resulting from side impacts.

The inner walls 114 and 122 of the legs are joined together at a rather sharply rounded 90° inner corner 131, and the outer walls 115 and 123 are also joined together at a rounded outer corner 132, which latter corner is normally rounded on a somewhat greater curvature or radius than is the inner corner 132.

The cross-section of the tube 111, and specifically the continuous and monolithic connection of the inner and outer walls and the curved end wall of each leg 112 and 113, and the connection of the inner walls and the outer walls at their respective corners 131 and 132, thus effectively define in cross-section a hollow endless perimeter wall which effectively defines an L-shaped configuration so that the inner wall can effectively embrace a substantially 90° edge or corner of the furniture unit, with the one leg 112 having the channel-like groove extending along the inner wall thereof and the other leg 113 having the channel-like groove extending along the outer wall thereof, whereby these grooves provide the individual legs and the overall tubular cross-section with increased strength and in particular increased resistance against bending or transverse buckling, particularly when subjected to compressive or column loading.

Further, the width of the hollow leg 113 as measured between the side walls 122, 123 is significantly greater than the width of the hollow leg 112 as measured between the side walls 114, 115. For example, in the illustrated and preferred embodiment, the width of leg 112 is in the neighborhood of about three-fourths inch, whereas the width of leg 113 is in the neighborhood of about five-fourths inch. The leg 112, however, has a length as measured from either corner 131 or 132 which is significantly greater than the length of leg 113 as measured from the same corner. For example, as measured from either corner 131 or corner 132, the leg 112 has a length or extent projecting outwardly from the corner which is approximately 1.5 times the length of the other leg 113 as it projects outwardly from the same corner.

The front edge posts 27 when used with the furniture unit 12 of FIG. 1, according to one embodiment of the invention, are also provided with a series of notches or openings 133 formed in the leg 113 thereof at spaced intervals lengthwise of the tube. The openings 133, in the lengthwise extent of the tube 111, are of limited dimension and are sized so as to accommodate therein the projecting handle or pull 15 provided on the drawer fronts of the furniture unit. Each opening 133, in the transverse dimension, extends from an edge 134 which is located approximately midway of the arcuate end wall 124, and extends inwardly along the inner wall 122 so as to terminate at a further edge 135 which is disposed adjacent and spaced slightly outwardly from the inner corner 131. The openings 133 thus enable the outwardly protruding drawer pull 15, adjacent the opposite ends thereof, to protrude into suitable openings 133 associated with the front corner posts 27.

In this embodiment the front corner posts 27 are provided with a pattern of openings 133 which is selected so as to accommodate a family of different drawer sizes and positional arrangements, and at the same time the same post member can be used for engagement with either front corner of the furniture unit 11 merely by inverting one post relative to the other, with the series of openings 133 being appropriately positioned so as to accommodate the drawer pulls. This normally requires that the post be provided with two series of openings 133 disposed in spaced relationship therealong, with one series being dimensioned from one end of the tube, and the other series being dimensioned from the other end of the tube, as illustrated by the plurality of openings 133 shown in FIGS. 11–12. As illustrated, one opening of each series can be disposed directly adjacent and in communication with the free end edge 136 of the tube if necessary or desired.

The rear posts 28 can be identical to the front posts 27 if desired. However, to minimize cost, the rear posts 28 are typically not provided with openings 133 since such is not required. The rear posts 28, however, in all other respects identically correspond to the construction of the front posts 27 as described above.

The posts 27–28 are constructed of paper and, more specifically, formed by paperboard which is initially wrapped, typically about three wraps of about 0.018 recycled paper-board, to create an elongate hollow tube which is thereafter compressed via a forming die into the desired cross-sectional shape. The construction of the post by this technique is known, and posts constructed according to this technique and having at least a general hollow L-shaped configuration are manufactured by Sonoco Products Co. of Hartsville, S.C.

In the improved posts 27, 28 of the present invention, the provision of the groove 18 associated with the inner wall 114 of leg 112, which leg overlaps a side wall of the furniture unit, has been observed to provide better protection for the furniture unit presumably due to the limited transverse flexibility permitted in the length of the leg 112, which legs due to surrounding banding can hence closely conform to and engage the furniture unit throughout the length of the vertical corners thereof.

The assembly of the components which make up the shipping package 10, and the assembly thereof to the furniture unit 11, will now be briefly described. The identical bottom and top trays 22 and 25 are initially assembled by creating the individual corners through appropriate adhesive securement of the double corner flaps to the respective end and side walls of the tray. The top tray assembly 24 is completed by inserting a pair of identical liners 51 into the interior of the top tray so that the liners extend across substantially the width of the top tray interior, and are disposed so as to substantially abut the opposite end walls, whereupon the liners are then adhesively secured to the inner surface of the top wall of the top tray. In this fashion the pair of liners are thus secured to the inner surface of the top wall of the top tray adjacent opposite ends of the top tray.

The bottom tray assembly is also assembled by initially folding two blanks 61 so as to define two inserts 23, which inserts in horizontally inverted relationship are then positioned inside the bottom tray so as to individually abut the opposite end walls of the bottom tray, with each insert being adhesively secured to its respective end wall to thus fixedly secure the inserts 23 within the bottom tray. The inserts 23 thus extend substantially across the width of the bottom tray and are fixedly positioned adjacent opposite ends thereof, substantially as diagrammatically illustrated in FIG. 7. The top and bottom trays are sized pursuant to the width and depth dimensions of the furniture unit being shipped, and the furniture unit is positioned so as to directly rest on the pair of inserts 23 associated with the bottom tray assembly 21, which hence causes the weight of the furniture unit to be transmitted directly onto the box structures 62 and the channel parts 64, as illustrated by those areas where contact occurs with the bottom frame 17 of the furniture unit 11. Since the two inserts 23 are disposed adjacent opposite ends of the bottom tray assembly, the opposite ends of the furniture unit 11 are hence supported by the box structure 62 associated with one of the inserts, and each side of the furniture unit frame is supported at spaced locations by a spaced pair of channel parts 64, thereby providing supportive engagement with the frame of the furniture unit at six locations. Further, the closed box-like structure 62 and the channel structure 64 maintain an air space therebelow in spaced relation above the bottom of the tray so as to provide for effective cushioning in the event of application of excessive external forces on the shipping package.

With the furniture unit positioned on the bottom tray assembly, any downwardly protruding casters or support glides readily fit within the corner recesses 106 without contacting the bottom wall of the tray.

The front corner posts 27 and rear corner posts 28 (without openings 133) are then positioned to embrace the vertically extending edges or corners of the furniture unit 11, with lower ends of the corner posts projecting downwardly into the recesses 106 for engagement with the bottom wall of the bottom tray. When the furniture unit has outwardly protruding pulls 15 on the drawer fronts, then the front posts 27 having notches 133 therein are preferably utilized so as to accommodate the ends of the drawer pulls therein while at the same time enabling the inner walls of the posts to snugly embrace the vertical surfaces of the furniture unit.

The top tray assembly 24 is then inverted and positioned downwardly over the top of the furniture unit so that the top surface of the furniture unit, adjacent opposite ends, engages the pair of cushioning liners 51 which are secured in the top tray adjacent opposite ends thereof. At the same time the upper ends of the posts 27, 28 project into the top tray adjacent the corners, and also engage the cushioning liners 51. The lengths of the posts 27, 28 are selected so that vertical loads, caused by vertical stacking of like shipping packages two or three high, will be transmitted predominantly through the upright corner posts rather than through the furniture unit. Since the lower ends of the posts directly engage the bottom wall of the bottom tray, whereas the furniture unit is supported in upwardly spaced relation by the inserts 23 which maintain an air space between the furniture unit and the bottom wall of the bottom tray, this hence ensures that the posts will predominantly transfer vertical loads therethrough, and thus prevent imposition of any significant vertical loading on the furniture unit. At the same time, the limited resiliency provided both by the bottom inserts 23 and the top liners 51 will thus be sufficient to maintain proper engaged relationship with the lower and upper ends of the furniture unit to prevent undesired looseness.

Once the corner posts as well as the bottom and top trays have been assembled around the furniture unit, then the package is appropriately banded, such as by horizontally and vertically wrapping the package to ensure that the entire shipping package remains fully assembled in protective surrounding relationship to the furniture unit. The package is preferably horizontally wrapped with stretch film such as polyethylene film and is also vertically wrapped with plastic bands such as polyester bands.

For units which have a relatively constant or fixed width W but which have a range of heights H and/or a range of depths D, then posts having lengths corresponding to the various predetermined heights H will be provided. Also, identical top and bottom trays having a desired depth so as to accommodate the predetermined depth D will also be provided, although the trays which accommodate the different depths will all utilize an identical pair of either bottom inserts 23 or top inserts 26, with the only difference being that the spacing between the assembled pair of inserts will progressively increase as the size of the tray increases in correspondence with the increase in the depth D of the furniture unit.

As to the posts, all posts can be provided with openings 133 therein so as to accommodate drawer pulls, and such posts can be used at the rear corners, and can also be used on furniture units which do not have protruding drawer pulls, such as the modified unit 11' illustrated in FIG. 14. If desired, however, posts 27 and 28 respectively with and without openings 133 can be provided so as to minimize cost, and such will normally be preferred, although it is recognized that this will require maintaining an inventory of two types of posts rather than only a single type.

Figure 15:
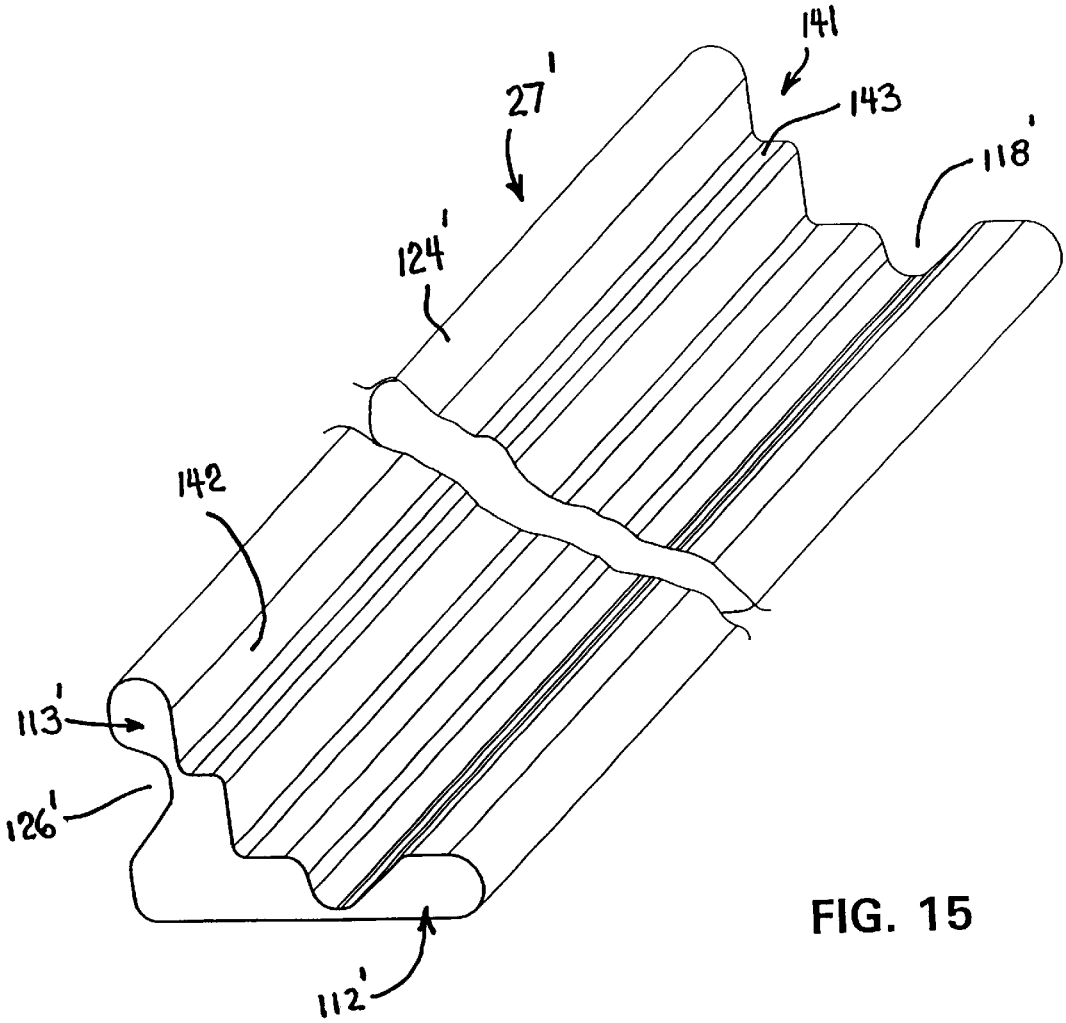
FIG. 15 is a perspective view like FIG. 11 but showing a modified and preferred corner post.
Figure 16:
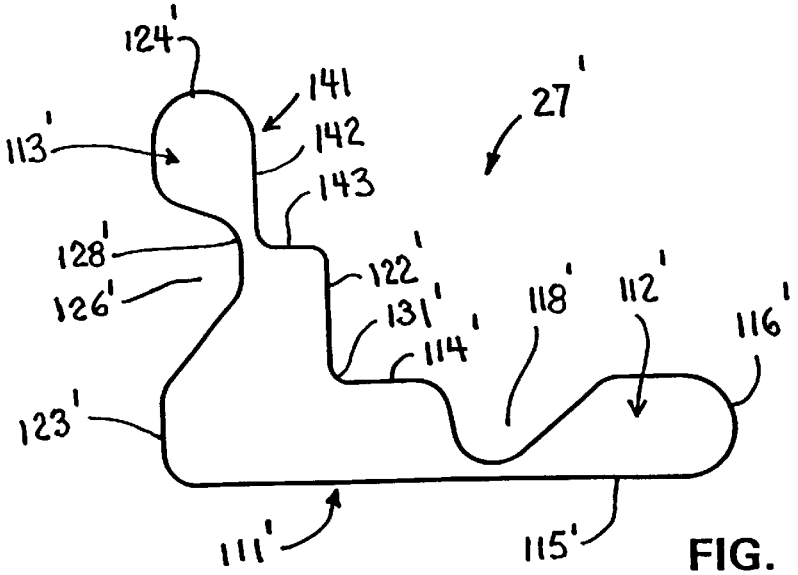
FIG. 16 is an enlarged end view of the modified corner post of FIG. 15.

Referring now to FIGS. 15 and 16, there is illustrated a modified but preferred embodiment of a corner post 27'. This corner post 27' includes many of the same positional and constructional features possessed by the post 27 as illustrated in FIGS. 11–13, and thus corresponding parts of the modified post 27' are identified by the same reference numerals but with the addition of a prime (') thereto.

More specifically, the modified post 27' is formed by an elongate, monolithic, one-piece hollow tube 111' formed of paper and is identical to the tube 111 of post 27 except in two respects, namely (1) post 27' does not have notches or openings (corresponding to openings 133 of post 27) formed through the wall of the hollow leg 113', and (2) the hollow leg 113' of post 27' has a step or shoulder 141 formed therein and extending along the full lengthwise extent thereof, as described in greater detail below.

More specifically, the step or shoulder 141 is formed in the outer end portion of the hollow leg 113' and opens inwardly from the inner wall 122' thereof. The step 141 is defined by a base wall 142 which extends in generally parallel relationship with the inner wall 122' but which is offset inwardly toward the outer wall 123', whereby the base wall 142 is thus disposed in a plane which is approximately midway between the side walls 122' and 123'. The step base wall 142 at its inner end joins through a rounded corner to a transversely-extending transition wall 143 which projects outwardly and joins through a further rounded corner to the inner wall 122'. The base wall 142 projects outwardly to the outer free end of the hollow leg 113' and joins to the rounded convex end wall 124' thereof.

The transition wall 143 is disposed so that, if extended, it would substantially intersect the groove 126' which is formed in and extends longitudinally along the hollow leg 113'. This transition wall 143 is also positioned, in the illustrated and preferred embodiment, about midway along the projecting length of hollow leg 113' as measured between the inner corner 131' and the end wall 124'. The offsetting of the base wall 142 from the inner wall 122', however, is dimensioned such that the base wall 142 is still maintained in spaced relation from the groove base wall 128' so that the hollow leg 113' retains impact or shock absorbing capability.

The step 141 thus defines an open recess or region which, starting at the transition wall 143, opens inwardly through a depth as bounded by the base wall 142, with this open region opening outwardly from the transition wall 143 through the free end of the leg 113'. This open region also extends continuously in an unobstructed manner throughout the entire longitudinal length of the post 27', substantially as illustrated in FIG. 15, due to the continuous formation of step 141 throughout the entire length of the post.

Due to the provision of the step or shoulder 141 associated with the post 27' and the associated clearance space or recess defined thereby, a pair of identical such posts 27' can be utilized for disposition adjacent and engagement with the front corners of the furniture unit 11 as illustrated in FIG. 1, whereby the clearance spaces defined by the steps 141 hence accommodate the ends of the drawer pulls 15, whereas the inner wall 122' can embrace the front surface of the drawers 14 along the edges thereof and adjacent the ends of the drawer pulls 15. While these modified posts 27' can also be used for engagement with the rear corners of the furniture unit 11, it is also possible to utilize the posts 28 (which are free of. both the openings 133 and the step 141) since they will provide engagement with the rear surface of the furniture unit over the full extent of the post leg.

With the improved shipping package 10 of this invention, all of the components including the upright posts as well as the entirety of the top and bottom tray assemblies are formed entirely of paper and hence, following use, can be readily and effectively disposed of by means of recycling.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A shipping package for an object of significant size and weight, comprising:

a bottom tray arrangement including a shallow upwardly opening bottom tray member having a horizontally large bottom wall joined to an upwardly projecting edge wall therearound which includes opposed side walls which extend between and join to opposed end walls, said bottom tray arrangement including a pair of load-supporting inserts positioned within and fixed to said bottom tray member respectively adjacent said pair of end walls, each insert including a horizontally large upper wall which is maintained in vertically spaced relation above and is separated from the bottom wall of the tray through an intermediate air space, said upper wall being disposed for direct supportive engagement with the object, said inserts and said bottom tray member all being constructed in their entirety of sheet corrugated paperboard;

a top tray arrangement having a shallow downwardly opening top tray member defined by a horizontally large top wall provided with a downwardly projecting edge wall therearound, said top tray member being constructed of sheet corrugated paperboard and being substantially identical to and disposed in opposed but vertically spaced relationship from said bottom tray member, said top tray assembly including a cushioning liner disposed within said top tray member and attached to an inner surface of said top wall, said liner member being attached to said top tray member adjacent opposite end walls thereof so that said top liner member is positionable for supportive engagement with a top surface of the object, the liner being constructed of paper;

a plurality of upright posts extending between said top and bottom tray arrangements, each said post being a one-piece hollow tubular element constructed of paper and having a generally hollow L-shaped cross-sectional configuration for embracing a vertically extending corner of the object, said post having a lower end engaged within a corner of the bottom tray member and disposed in load transfer relationship with the bottom wall thereof, said post having an upper end projecting into a corresponding corner of the top tray member and engaged in load-bearing engagement with the liner which is secured to the top tray member;

whereby said object is positioned to extend vertically between the top and bottom tray arrangements so that the load is supported directly on the upper wall of the inserts disposed within the bottom tray member, whereas vertical external loads imposed on the top tray arrangement are transmitted predominantly downwardly through the posts to the bottom tray member.

2. A shipping package according to claim 1, wherein said insert includes a hollow closed structure defined by vertically spaced and generally parallel top and bottom walls joined by generally parallel upright edge walls, said hollow closed structure also including foldable edge flaps secured to opposite side edges of said top and bottom walls and being folded into overlapping engagement and adhesively secured together, said closed structure being disposed closely adjacent and positioned centrally relative-to one upright end wall of said bottom tray member, the bottom wall of said box-like structure being disposed in overlapping engagement with the bottom wall of said bottom tray member, and the top wall of said closed structure defining at least part of said upper wall of said insert.

3. A shipping container according to claim 2, wherein said insert includes a downwardly oriented channel structure which includes a top wall which extends between and joins to a pair of vertical edge walls which project downwardly therefrom, said channel structure being spaced laterally from said closed structure and disposed outwardly and generally parallel with the respective end wall so as to extend generally transversely between the opposed side walls of the bottom tray member, the top wall of the channel part defining at least part of the upper wall of the insert.

4. A shipping package according to claim 3, wherein said insert is formed in its entirety from a monolithic one-piece flat blank of corrugated paper-board.

5. A shipping package according to claim 3, wherein said closed structure is spaced inwardly from corners of the bottom tray member so as to define open recesses adjacent the corners to provide clearance for downward protrusions provided adjacent the corners of the object.

6. A shipping package according to claim 1, wherein each of said first and second legs of said post is defined by generally parallel inner and outer walls disposed in spaced relation and at outer ends joined together by an end wall, the inner wall of said first leg having a groove formed therein and defined by a channel wall part which protrudes into the interior of the leg and which has a bottom wall which is positioned more closely adjacent the respective outer wall of said first leg, and said second leg having a groove formed in the outer leg and defined by a channel wall part which protrudes inwardly toward but is disposed in spaced relationship from the respective inner wall of said second leg.

7. A shipping package according to claim 6, wherein said second leg has a step shoulder formed in the inner wall thereof with said shoulder being offset inwardly toward the respective outer wall so that said shoulder defines a clearance space which extends lengthwise throughout the longitudinal extent of the post and which opens outwardly through the free end of said second leg for accommodating protrusions associated with the object.

8. A shipping package according to claim 6, wherein said second leg has a plurality of openings formed through said inner wall in the vicinity of the free end of said second leg for accommodating therein protrusions associated with the object.

9. A shipping package according to claim 1, wherein the liner which is fixed interiorly of said top tray member comprises a paper member having a core layer defined by a paper honeycomb structure having a vertical thickness of at least about three-fourths inch.

10. A shipping package according to claim 1, wherein each of said top and bottom tray members is formed from a one-piece blank of corrugated paperboard, said blank having at each corner thereof a pair of corner flaps, one of said corner flaps being secured by a fold line to one of the side walls and wrapping around and being adhesively engaged with one of the faces of the adjacent end wall, and the other end flap being engaged with and foldably connected to the end wall and wrapped around and adhesively engaged with an opposed face of the adjacent side wall, one of said flaps at the corner being positioned interiorly of the side and end walls, the other flap being positioned exteriorly of the side and end walls.

11. A shipping package according to claim 1, wherein said object comprises a furniture unit having a box shape hollow housing provided with slidable drawers having drawer faces which close off and define an open side of said housing.

12. A shipping package according to claim 2, wherein each of said first and second legs of said post is defined by generally parallel inner and outer walls disposed in spaced relation and at outer ends joined together by an end wall, the inner wall of said first leg having a groove formed therein and defined by a channel wall part which protrudes into the interior of the leg and which has a bottom wall which is positioned more closely adjacent the respective outer wall of said first leg, and said second leg having a groove formed in the outer leg and defined by a channel wall part which protrudes inwardly toward but is disposed in spaced relationship from the respective inner wall of said second leg.

13. A shipping package according to claim 12, wherein said second leg has a step shoulder formed in the inner wall thereof with said shoulder being offset inwardly toward the respective outer wall so that said shoulder defines a clearance space which extends lengthwise throughout the longitudinal extent of the post and which opens outwardly through the free end of said second leg for accommodating protrusions associated with the object.

14. A shipping package according to claim 13, wherein the liner which is fixed interiorly of said top tray member comprises a pair of sheet paper members which are secured to the inner surface of the top wall of said top tray in sidewardly spaced relationship adjacent the opposite end walls of the top tray, each said paper member having a paper honeycomb core structure oriented so that cells of the honeycomb core structure extend transversely relative to the top wall of the top tray.

* * * * *